US005881838A

United States Patent [19]

Swanick, Jr.

[11] Patent Number: 5,881,838

[45] **Date of Patent: *Mar. 16, 1999**

[54] LADDER HAVING MOVABLE LADDER SUPPORT

[75] Inventor: Paul E. Swanick, Jr., Carbondale, Pa.

[73] Assignee: P&S Improvements, Inc., Carbondale, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 702,883

[22] Filed: Aug. 26, 1996

[51] Int. Cl.[6] ..... E04G 5/02

[52] U.S. Cl. ..... 182/107; 182/214

[58] Field of Search ..... 182/107, 129, 182/214; 248/345.1

[56] References Cited

U.S. PATENT DOCUMENTS

| | | | |
|---|---|---|---|
| 504,008 | 8/1893 | Webster | 182/207 |
| 856,875 | 6/1907 | Hughes et al. | 182/207 X |
| 1,285,918 | 11/1918 | Brown | 182/107 |
| 1,606,198 | 11/1926 | Werk | 182/107 |
| 2,815,160 | 12/1957 | Gilmour et al. | 182/107 |
| 3,446,309 | 5/1969 | Davis et al. | 182/129 |
| 4,311,207 | 1/1982 | Lurry | 182/206 |
| 4,394,887 | 7/1983 | Spinks | 182/107 X |
| 4,580,660 | 4/1986 | Oling | 182/107 |
| 5,123,503 | 6/1992 | Clarke | 182/107 |

*Primary Examiner*—Ramon O. Ramirez
*Assistant Examiner*—Long Dinh Phan
*Attorney, Agent, or Firm*—Law Offices Of John A. Parrish

[57] ABSTRACT

The invention provides a movable ladder support device, and a ladder which includes that support device. The support device includes a rotatable member such as a wheel housed within the U-shaped section of the support device. The support device is attached to the rail of a ladder. The support device enables the ladder to be vertically repositioned against the surface of an inclined wall without the need to first remove the ladder from the surface.

8 Claims, 3 Drawing Sheets

LADDER HAVING MOVABLE LADDER SUPPORT

FIELD OF THE INVENTION

The invention relates to ladder supports, more particularly to supports which facilitate movement of a ladder. The invention also relates to ladders which employ these supports.

BACKGROUND OF THE INVENTION

In the performance of their occupation, workmen such as painters, carpenters, roofers often must reposition a ladder against an inclined work surface such as inclined and vertical surfaces. Repositioning of a ladder, such as the extension member of an extension ladder, against these surfaces is a time consuming operation. The time wasted in repositioning the ladder adds substantial expense to labor intensive operations such as painting. This expense is also increased since two people are often needed to reposition long, relatively heavy ladders. Moreover, during reposition of the ladder requires moving the ladder away from the wall and maintaining the ladder in a balanced position until the ladder is again resting against the wall. If this balanced position is lost, the ladder can crash and cause property damage and injure the user. A need therefore exists for devices which facilitate repositioning of ladders, as well as ladders which can be readily positioned to a desired location and which overcome the disadvantages of conventional ladders.

SUMMARY OF THE INVENTION

The invention relates to a novel support device, and to a ladder which includes that support device. The support device of the invention includes means for positioning the ladder on an inclined surface. The support member includes a bracket member and a rotatable device such as a wheel housed in the bracket member. The bracket member includes a U-shaped section for retaining the wheel member, and an elongated section for attachment to the ladder. The elongated section can be at a substantially right angle to the U-shaped section.

DETAILED DESCRIPTION OF THE INVENTION

In accordance with the invention, a support device for a ladder and a ladder having the support device is provided. The ladder having the support device easily can be positioned on inclined surfaces such as pitched roofs and the like by a single user.

Figure 2:
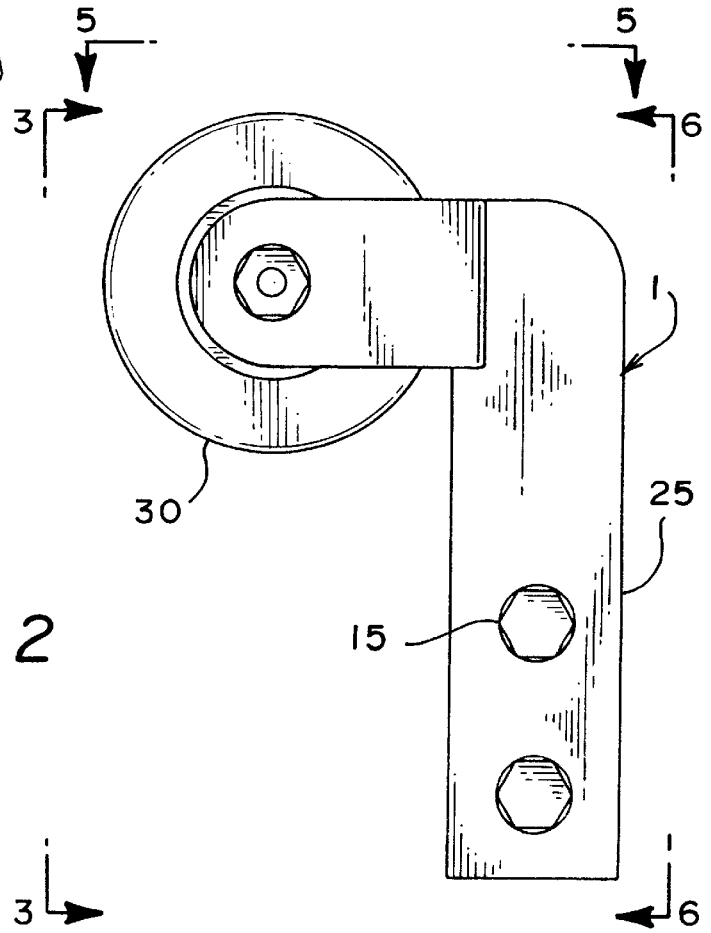
FIG. 2 is a side view of the support device of the invention.
Figure 3:
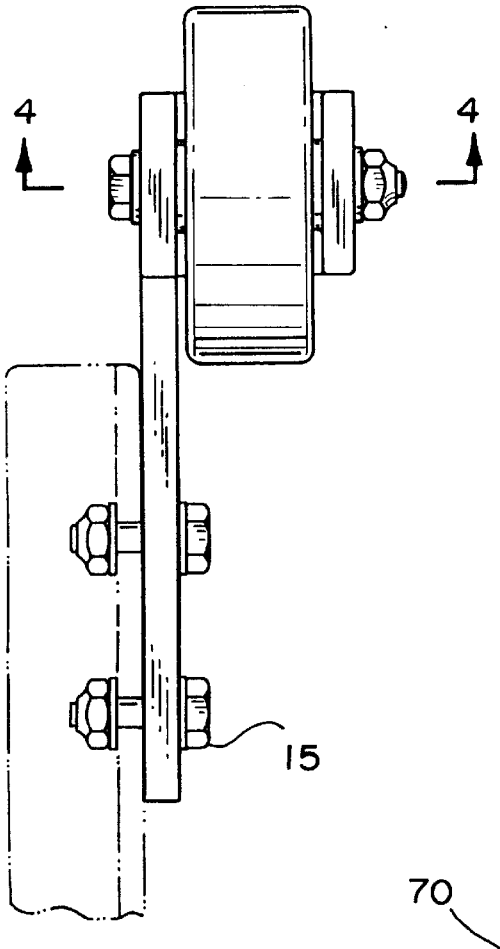
FIG. 3 a top view of the support device of the invention joined to a section of the ladder as shown in FIG. 1.
Figure 5:
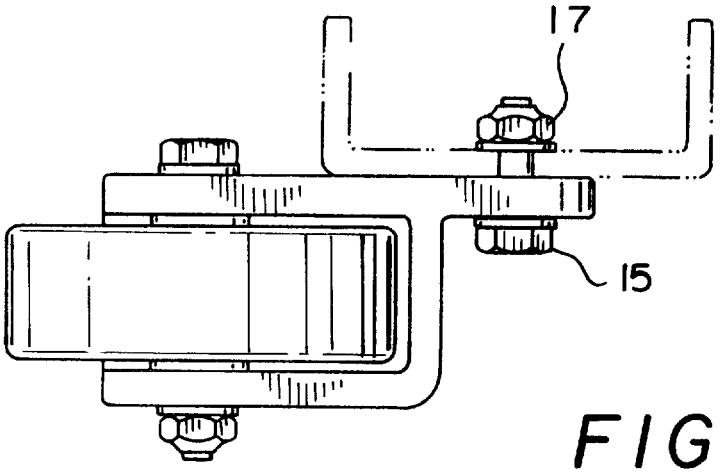
FIG. 5 is a front view of the support device of the invention attached to a ladder as shown in FIG. 4.

FIGS. 2,3 and 5 show a novel, detachable support device 1 which can be secured to rail 5A of ladder 5 by any useful fastening means such as screws, rivets, bolts and the like, preferably bolts. Preferably, bolts 15 pass through holes 20A in extended lateral portion 25 of bracket 20 and through holes 20A in rail 5A. Bolts 15 are retained by lock nuts 17.

Figure 4:
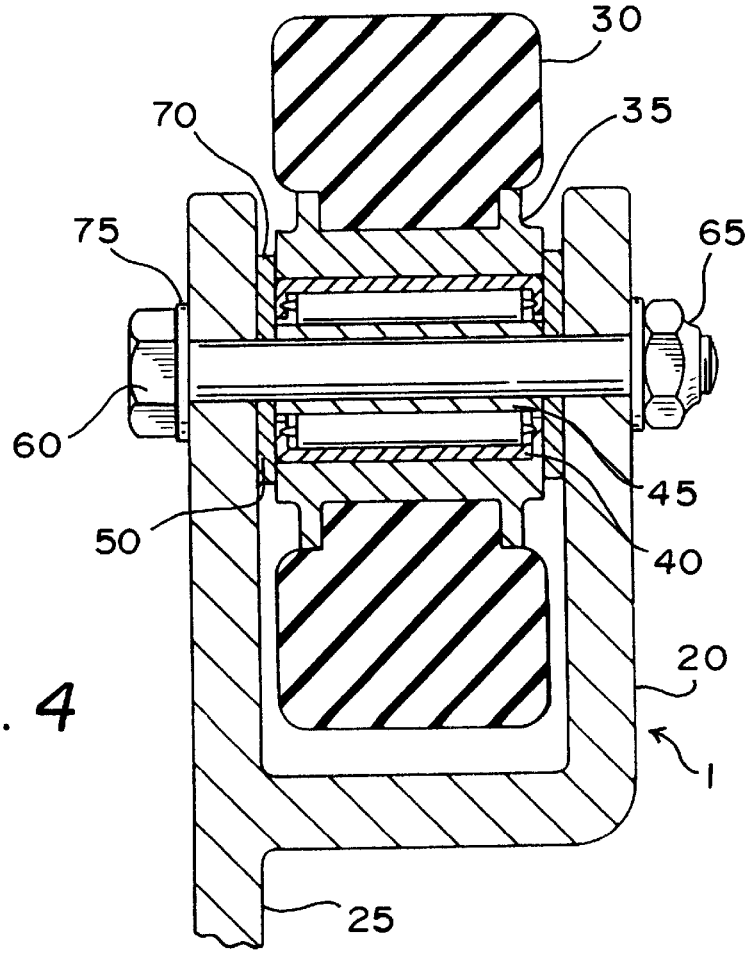
FIG. 4 is a cross sectional view of the support device shown in FIG. 3.

As shown in FIGS. 1–6, support device 1 further includes a rolling means for enabling movement of the ladder, as discussed below, against the surface of a wall Bracket 20 of support device 1 includes a U-shaped section for housing the rolling means, and an extended lateral section 25 for securing bracket 20 to rail 5A of ladder 5. Preferably, the rolling means is wheel 30. Wheel 30 is positioned in the U-shaped section of bracket 20 so that wheel 30 extends beneath rail 5A as shown in FIG. 4. Rail 5A has elongated lateral surfaces 5B and upper and lower cross sectional surfaces 5C. Wheel 30 can extend to various depths beneath rail 5A. Typically, wheel 30 can extend between about 0.25 inches to about four inches below the U-shaped section of bracket 20.

Wheel 30 may have a round circumferential surface, or a circumferential surface which has any number of lateral portions to provide, for example, an octagonal, or heptagonal surface. Preferably, wheel 30 is round. Wheel 30 may be made of a variety of materials such as rubber, and nylon, as well as olefins such as polybutylene, polyethylene, and the like. Preferably, wheel 30 is rubber. More preferably, wheel 30 is skid proof rubber to enhance rolling while minimizing sliding of wheel 30 against a contact surface such as an inclined wall.

Wheel 30, as shown in FIG. 4, may rotate within U-shaped section of bracket 20 on any conventional means such as an axle, preferably an axle in the form of elongated bolt 60 secured by nut 65 on hub 35. Hub 35 includes bearings 40 and 45. Bearings 40, 45 may be roller bearings or sleeve bearings. Bolt 15 passes through an opening provided in the U-shaped section of bracket 20 and bearing support 35 as shown in FIG. 4. Wheel 30 is secured in bracket 20 by bolt 15 and locking nut 65. Bearing washers 70 and 75 may be employed as required to secure wheel 30 within the U-shaped section of bracket 20.

Bracket 20 of support device 1 may be made from a variety of materials such as thermoplastics, nylons, metals, composites and the like. Preferably, bracket 20 is steel The steel preferably is coated with plastic and or oxidation resistance metals to resist corrosion. Bearings 40 and 45, and hub 35 also may be formed from a wide variety of materials, the choice of which would be readily apparent to those skilled in the art.

Figure 1:
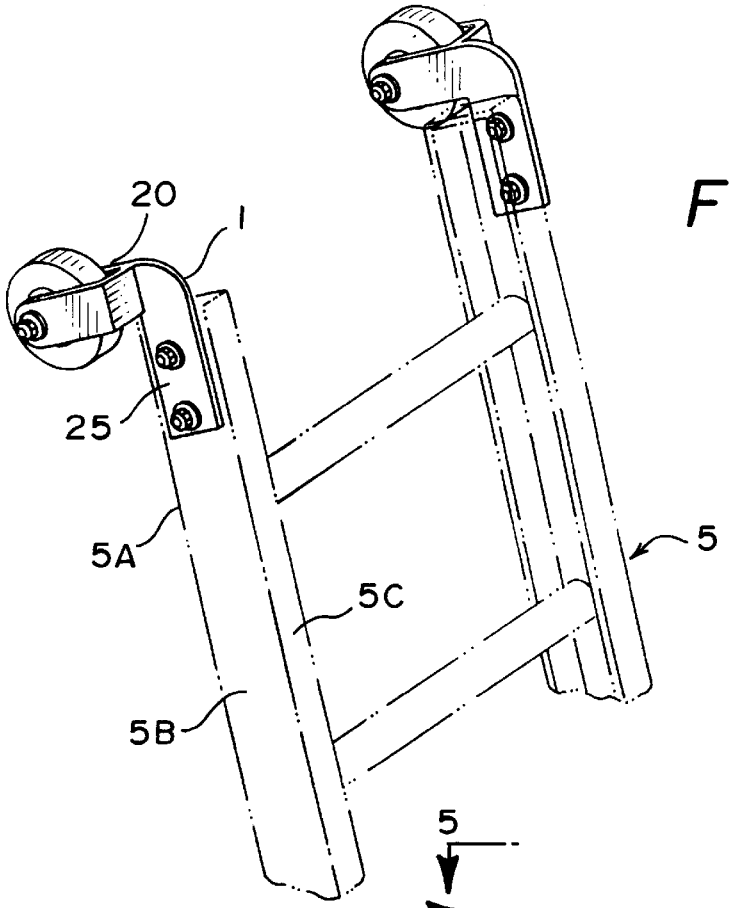
FIG. 1 is a top perspective view in partial cross section of a ladder of the invention that employs the support device of the invention.
Figure 6:
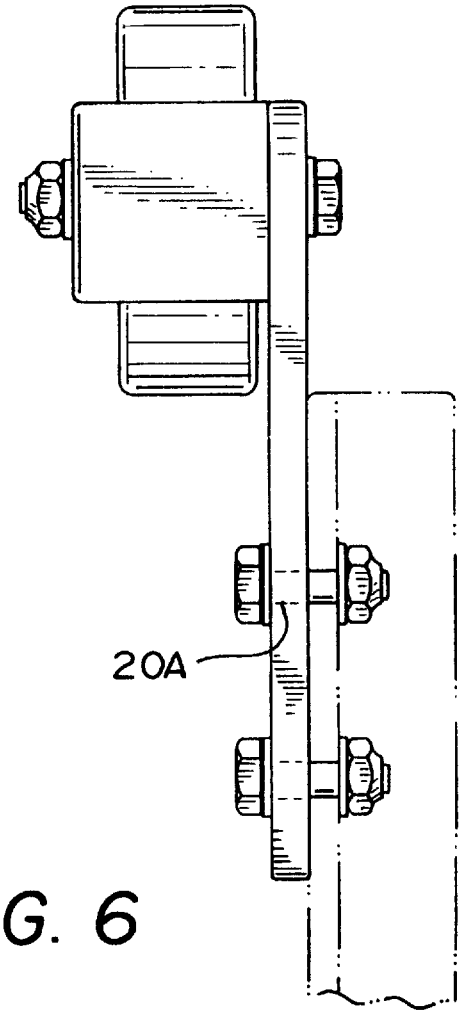
FIG. 6 is a side view of a ladder with the support device of the invention attached to the runner portion of the ladder.

Support device 1 is secured to rail 5A of ladder 5 by bolts 15 as shown in FIG. 1 and FIG. 6. Although support device 1 can be attached to any desired location on ladder 5, support device preferably is attached to the upper portion of rail 5A of ladder 5.

During use, the upper end of ladder 5 having support device 1 is positioned against a wall or other inclined surface so that wheel 30 of support device 1, rather than rail 5A of ladder 5 rests against the wall. When a user desires to reposition ladder 5, such as to a new vertical position on the wall, a single user can easily do so by vertically pushing on ladder 5 so that wheels 30 roll against the wall in a vertical direction. In contrast to the prior art, repositioning of the ladder of the invention can be accomplished without pulling the ladder away from the surface of the wall. A single user who may lack physical strength can thus reposition the ladder as necessary.

I claim:

1. An apparatus which can be repositioned against a vertically inclined surface without removing the apparatus from the inclined surface, the apparatus comprising:

a ladder having a rail having an elongated surface and a cross sectional surface adjacent to the elongated surface;

a support device including a U-shaped section integrally connected with an elongated lateral section substantially at a right angle thereto;

a rolling means rotatably attached to the U-shaped section for enabling movement of the apparatus in a vertical direction;

wherein the lateral section of the support device is attached to the elongated surface of the rail of the ladder at a vertically fixed position and such that the U-shaped section extends distally and laterally away from an end of the rail of the ladder.

2. The apparatus of claim 1 wherein said rolling means comprises a wheel.

3. The apparatus of claim 2 wherein said wheel has a circumferential surface having lateral porions.

4. The apparatus of claim 3 wherein said circumferential surface is substantially circular.

5. The apparatus of claim 1 wherein said U-shaped section has a length substantially smaller than the diameter of said wheel.

6. The apparatus of claim 1 wherein said elongated portion includes holes therein for receiving fastening means for securing said device to a support member.

7. The apparatus of claim 6 wherein said fastening means is at least one of bolts, rivets, and screws.

8. The apparatus of claim 7 wherein said fastening means is bolts.

* * * * *